US005344707A

United States Patent [19]

Snyder

[11] Patent Number: 5,344,707

[45] Date of Patent: Sep. 6, 1994

[54] FILLINGS AND OTHER ASPECTS OF FIBERS

[75] Inventor: Adrian C. Snyder, Greenville, N.C.

[73] Assignee: E. I. Du Pont de Nemours and Company, Wilmington, Del.

[21] Appl. No.: 10,215

[22] Filed: Jan. 28, 1993

Related U.S. Application Data

[60] Continuation-in-part of Ser. No. 820,141, Jan. 13, 1992, Pat. No. 5,238,612, which is a division of Ser. No. 589,960, Sep. 28, 1990, Pat. No. 5,112,684, which is a continuation-in-part of Ser. No. 508,878, Apr. 12, 1990, Ser. No. 549,818, Jul. 9, 1990, and Ser. No. 549,847, Jul. 9, 1990, said Ser. No. 549,818, and Ser. No. 549,847, each is a continuation-in-part of Ser. No. 290,385, Dec. 27, 1980, Pat. No. 4,940,502, which is a continuation-in-part of Ser. No. 921,644, Oct. 21, 1986, Pat. No. 4,794,038, which is a continuation-in-part of Ser. No. 734,423, May 15, 1985, Pat. No. 4,618,531, and Ser. No. 840,285, Feb. 24, 1992, Pat. No. 5,218,740, which is a continuation-in-part of Ser. No. 508,878, Apr. 12, 1990.

[51] Int. Cl.[5] ..... D02G 3/00; D02G 1/00

[52] U.S. Cl. ..... 428/359; 428/362; 428/369; 428/370; 428/371; 428/373; 428/374; 428/391; 428/395

[58] Field of Search ..... 428/224, 280, 296, 297, 428/299, 357, 359, 288, 362, 391, 395, 369, 90, 370, 371, 373, 374

[56] References Cited

U.S. PATENT DOCUMENTS

| | | | |
|---|---|---|---|
| 3,946,469 | 3/1976 | Benson | 428/288 |
| 4,118,531 | 10/1978 | Hauser | 428/224 |
| 4,281,042 | 7/1981 | Pamm | 428/288 |
| 4,418,103 | 3/1983 | Tani et al. | 428/90 |
| 4,588,635 | 5/1986 | Donovan | 428/288 |
| 4,618,531 | 10/1986 | Marcus | 428/283 |
| 4,783,364 | 11/1988 | Marcus | 428/288 |
| 4,794,038 | 11/1988 | Marcus | 428/288 |
| 4,940,502 | 7/1990 | Marcus | 156/272.2 |
| 4,992,327 | 2/1991 | Donovan | 428/288 |
| 5,043,207 | 8/1991 | Donovan et al. | 428/288 |
| 5,112,684 | 5/1992 | Halm et al. | 428/357 |
| 5,169,580 | 7/1992 | Marcus | 428/296 |
| 5,238,612 | 8/1993 | Halm et al. | 428/357 |

*Primary Examiner*—Patrick J. Ryan
*Assistant Examiner*—Patrick R. Jewik

[57] ABSTRACT

Fiberballs for filling uses in pillows, cushions and for like support purposes, from blends of slickened fiberfill of regular denier, to provide support and resilience, mixed with minor amounts of lower denier slickened fibers to provide optimum aesthetics.

6 Claims, No Drawings

FILLINGS AND OTHER ASPECTS OF FIBERS

CROSS REFERENCE TO RELATED APPLICATION

This application is a continuation-in-part of copending application (DP-4615-A) Ser. No. 07/820,141, now U.S. Pat. No. 5,238,612, filed Jan. 13, 1992, which is a division of application (DP-4615) Ser. No. 07/589,960, filed Sep. 28, 1990, now issued as U.S. Pat. No. 5,112,684, itself a continuation-in-part of applications (DP-4690) Ser. No. 07/508,878, filed Apr. 12, 1990 by Snyder and Vaughn, and (DP-4390-A) Ser. No. 07/549,818 and (DP-4391) Ser. No. 07/549,847, each themselves filed Jul. 9, 1990 by Marcus as continuations-in-part of application (DP-4390) Ser. No. 07/290,385, filed Dec. 27, 1988, now issued as U.S. Pat. No. 4.940,502, itself a continuation-in-part of application Ser. No. 06/921,644, filed Oct. 21, 1986, now issued as U.S. Pat. No. 4,794,038, Dec. 27, 1988, itself a continuation-in-part of applicaton Ser. No. 734, 423, filed May 15, 1985, now issued as U.S. Pat. No. 4,618,531, and also a continuation-in-part of application (DP-4690-A) Ser. No. 07/840,285, filed Feb. 24, 1992, now U.S. Pat. No. 5,218,740 by Snyder and Vaughn, as continuation-in-part of above-mentioned (DP-4690) application Ser. No. 07/508,878.

FIELD OF INVENTION

This invention relates to improvements in fiber filling material, especially polyester fiberfill, and more particularly fiberfill which is in a fiberball form, and other aspects and uses of these and other fibers.

BACKGROUND OF THE INVENTION

Polyester fiberfill has become widely used and well accepted as a relatively inexpensive filling material for pillows, quilts, sleeping bags, apparel, furniture cushions, mattresses and similar articles. It has generally been made of polyethylene terephthalate staple (i.e. cut) fibers that have been cut from filaments crimped in a stuffer box-type of crimper. The deniers (or dtex) of the fibers have generally been of the order of 5–6, i.e. a significantly higher denier per filament (dpf) than cotton fibers and polyester textile fibers used in apparel; this is because an important requirement for most filling material has been its resilience. The fibers may be hollow or solid, and may have a regular round or another cross section, and are cut to various lengths according to the requirements of the end-use or the process.

Polyester fiberfill is often "slickened", i.e. coated with silicones and more recently with polyethylene terephthalate/polyether segmented copolymers, to reduce the fiber/fiber friction. A low fiber/fiber friction improves the hand of the finished article made from the fiberfill, producing a slicker and softer hand, and contributes to reducing a tendency of the fiberfill to mat (or clump together) in the article during use.

Polyester fiberfill staple has generally been processed by being opened and then formed into webs which are cross-lapped to form a wadding (also referred to as a batt) which is used to fill the article. The performance of articles that have been filled using this technique has been satisfactory in many end-uses for many years, but could not fully reproduce the aesthetics of natural fillings such as down and down/feather blends. Such natural fillings have a structure that is fundamentally different from carded polyester fiberfill batts; they are composed of small particles with no continuity of the filling material; this allows the particles to move around within the ticking and to adapt the shape of the article to the user's contours or desires. We believe that the ease with which down and feather fillings can move around plays a key role in their recovery from compression after being compacted, by simple shaking and patting. This virtue is referred to as refluffability.

Contrary to down and feather, the carded polyester fiberfill batts have a layered structure, in which the fibers are parallelised, and are loosely interconnected within each web and between the layers so they cannot be moved around and refluffed in a similar way to down and feather. Polyester fillings have, however, some advantages over natural fillings, particularly in regard to washability and durability. Accordingly, Marcus has developed a fiberfill product composed of small, soft polyester fiber clusters or fiberballs which keep their identity during wear and laundering and enable the user to refluff the article filled with the fiberfill. These clusters combine the good mechanical properties and washability of polyester fiberfill with the refluffability of down or down/feather blends.

Although some particulate products had been produced commercially on modified cards from standard fiberfill, such products were prepared for different end-uses, and did not have the properties required for manufacture of high quality bedding or furniture articles. Steinruck disclosed one such modified card and process for making "nubs" in U.S. Pat. No. 2,923,980.

Marcus made his new fiberballs using fibers with specific characteristics as feed for a new fiberball-making process. U.S. Pat. Nos. 4,618,531 and 4,783,364 (referred to above) disclosed preferred fiberball products and a process to produce them from spiral crimp (including omega crimp) feed fibers, which can be rolled under mild conditions due to their potential for spontaneous curling. These products have been commercially successful in the U.S. and Europe, mainly in bedding and furniture cushions. Marcus demonstrated that such "spiral crimp", which some people prefer to refer to as "helical crimp", was important for achieving the desired fiberball structure, i.e. in providing a desired random arrangement of the fibers within each fiberball, and in achieving a desired low cohesion between the surfaces of neighboring balls. Commercial fibers with standard mechanical crimp did not produce fiberballs having the desired fiberball structure which provides good durability, high filling power and low cohesion, which are key requirements for refluffable filling products.

To optimize the filling power (i.e. to increase the bulk) and durability (i.e. to lower the amount of bulk lost during use), and particularly the durability to laundering, we believed that the entangled fibers forming the fiberball structure should be randomly distributed, should have a uniform density throughout the structure, and should be sufficiently entangled to keep the fiberball identity through laundering or during normal wear. To achieve optimum filling power and durability, we believed it to be important that each such fiber within the fiberball should have its bulk fully and individually developed, so that it could fully contribute (to the filling power and to the durability). To achieve this structure, on which depends the performance of the fiberballs, Marcus used fibers which tend to spontaneously curl, so that a good, consolidated structure could be produced under very mild forces. In the aforesaid patents, Marcus disclosed a preferred way to achieve this desired fiberball structure and properties by using fibers with helical crimp as feed fibers and an air tumbling process to roll the fibers under mild forces. The resulting products are characterized by a random distribution of the fibers within the fiberball, by being at least 50% round (having a ratio of the largest dimension to the smallest dimension of less than 2:1) and by having a low cohesion which was not shown in prior products. Marcus did not produce acceptable fiberballs under the same conditions using commercial fibers with standard mechanical crimp.

The feed fibers used by Marcus to make his new fiberballs were relatively unusual, unavailable and/or expensive in some markets, in which by far the majority of polyester staple fiber were crimped mechanically, generally by a stuffer box technique. After Marcus disclosed the value of using fiberfill in the form of a fiberball, rather than as parallelised fibers in a carded batt-type structure, it was desirable to find out why standard mechanically crimped fibers did not make good fiberballs, and to provide a feed fiber other than what Marcus used. Snyder et al in copending U.S. application Ser. No. 07/840,285 (referred to above) disclosed another process and apparatus for making fiber clusters, and succeeded in processing mechanically crimped feed fiber into satisfactory fiber clusters. An important object of parent applications 07/589,960, now U.S. Pat. Nos. 5,112,684, and 07/820,141 (referred to above) was to provide such mechanically crimped feed fiber that has the capability of being processed into such clusters, sometimes termed fiberballs. As expressed therein, the principles of the parent invention can also be applied to making clusters from fibers other than polyester fiberfill.

Removable, refluffable cushions are now typical in modern furniture styling. This has created a new need for refluffable fiberfill, so the cushions can be replumped. Furniture also requires filling products having more support and filling power than bedding or apparel. This sometimes requires fibers of higher denier, such as may require different crimping conditions from fibers of the order of 5–6 denier or dtex.

Accordingly, as disclosed in the parent applications, it was found that fiberballs with comparable properties could be produced from certain mechanically crimped fibers which have specific crimp configurations. An important characteristic is believed to be a potential to curl spontaneously that is similar in this respect to that of the spiral crimped fibers used as feed fibers by Marcus. Suitable feed fibers have been used with combinations of primary and secondary crimp with specific ranges of frequency and amplitudes. The precise ranges of values required will depend on various considerations, such as the denier and configuration of the feed fiber, and the process technique used to make the balls. The frequency and amplitude of the secondary crimp, especially, and good heat setting of this secondary crimp, are believed to be key requirements for making fiberballs.

Accordingly, one aspect of the parent invention was to provide refluffable fiberballs having a uniform density, and a random distribution and entanglement of fibers within each ball characterized in that the fiberballs have an average cross-section dimension of about 2 to about 20 mm, and that the individual fibers have a length in the range of about 10 to 100 mm and are prepared from fibers having a primary crimp and a secondary crimp, said primary crimp having an average frequency of about 14 to about 40 crimps per 10 cm and said secondary crimp having an average frequency of about 4 to about 16 crimps per 10 cm, and having an average amplitude from the fiber longitudinal axis of at least 4 times the average amplitude of the primary crimps.

Also provided were fiberballs having a random distribution and entanglement of fibers within each ball, said fibers being a blend of load bearing fibers and binder fibers, which optionally contain a material capable of being heated when subjected to microwaves or a high frequency energy source, characterized in that the fiberballs have an average diameter of from about 2 mm to about 20 mm and the individual fibers have a length of about 10 to about 100 mm, the load-bearing fibers having primary crimp and a secondary crimp, said primary crimp having an average frequency of about 14 to about 40 crimps/10 cm and the said secondary crimp having an average frequency of from about 4 to about 16 crimps/10 cm, and whereby the average amplitude of the secondary crimp is at least 4 times the average amplitude of the primary crimp.

Further provided were processes for making the aforesaid fiberballs as more fully described therein.

Additionally provided were molded structures prepared from fiberballs which contain binder fibers.

Other aspects of the invention were preferred feed fibers for making the fiberballs, and processes involved in making suitable feed fibers.

Accordingly, processes were provided for mechanically crimping a tow band of polyester filaments of lower denier (about 4 to about 10 dtex) per filament in a stuffer box crimper at a crimper loading of about 13 to about 26 ktex per inch of crimper width, and for heat-setting the crimped tow band to provide crimped filaments having a primary crimp with an average frequency of about 14 to about 40 per 10 cm and a secondary crimp with an average frequency of about 4 to about 16 per 10 cm, and an average amplitude at least 4× the average amplitude of the primary crimp and for converting the resulting crimped tow band into cut fiber to provide feed fiber for a process for making fiberballs from such feed fiber, and for making such fiberballs by an air-tumbling process or by using a ball-making machine equipped with card clothing, e.g. of the modified roller-top type, or as disclosed, e.g., by Snyder et al. in U.S. application Ser. No. 07/840,285, and preferred mechanically-crimped feed fiber for use in such ball-making machines and processes. Similar processes provided for polyester filaments of higher dtex, with crimper loadings, e.g., up to about 34 ktex per inch, correspondingly. The appropriate crimp need not be induced only by use of a mechanical crimper of the stuffer box-type, for example, but alternative methods of inducing the appropriate structure, were also contemplated.

SUMMARY OF THE INVENTION

We have now found advantages in providing pillows, cushions and like articles of fiberballs from blends of such mechanically-crimped fiberfill with minor amounts of subdenier fibers, or lower denier fibers of denier about 1.5 or less, preferably, at least 0.2 to 1. As indicated, deniers of fibers used commercially for such fiberfill have generally hitherto been substantially higher, of the order of 5–6 denier, and even higher deniers are preferred for certain purposes, such as removable, refluffable cushions, because of the resilience and support of such higher denier fibers. Low denier fibers are known to provide good thermal insulation, but are not believed to have sufficient resilience for use as support in cushions, or in pillows, where thermal insulation is not a prime consideration. It is, therefore, surprising that certain blends, using minor amounts of low denier fibers, have been found advantageous in support articles.

Accordingly, there are now provided improved fiberballs having a random distribution and entanglement of individual fibers within each fiberball and of average diameter about 2 to 20 mm, comprising fibers that are slickened and of length about 10 to about 100 mm, the improvement being characterized in that the fibers consist essentially of about 10 to about 50% by weight of lower denier fibers of lower denier about 0.2 to about 1, and complementally about 90 to about 50% of fiberfill of higher denier that is about 2 to about 20, and is at least about 3 times said lower denier, and said fiberfill being mechanically-crimped with significant secondary crimp, in addition to primary crimp, whereby such fibers are entangled in the form of fiberballs.

Also provided, according to the present invention, are improved fiberballs having a random distribution and entanglement of individual fibers within each fiberball and of average diameter about 2 to about 20 mm, comprising fibers that are slickened and of length about 10 to about 100 mm, the improvement being characterized in that the fibers consist essentially of about 10 to about 50% by weight of lower denier fibers of lower denier about 0.2 to about 1, and complementally about 90 to about 50% of fiberfill of higher denier that is about 2 to about 20, and is at least about 3 times said lower denier, and said fiberfill having a helical crimp whereby such fibers are entangled in the form of fiberballs, as the advantages of lower denier fibers are not restricted to fiberballs made only from mechanically-crimped fiberfill.

Also provided, according to the present invention, are such fiberballs wherein some of the fiberfill of higher denier is mechanically-crimped as indicated, while some has a helical crimp as indicated.

Preferred aspects include such blends containing up to 30%, by weight of such lower denier fibers, such lower denier being about 0.6 to 1, and such higher denier being about 4 to 10.

Other aspects include processes and filled articles, such as pillows, cushions and like filled articles, including such articles having continuous filament ticking fabric, especially those with low denier filaments in the ticking.

DETAILED DESCRIPTION OF THE INVENTION

According to the parent invention, certain mechanically-crimped feed fibers can produce fiberballs with refluffability and durability characteristics similar to those produced from spiral crimp fibers (sometimes referred to as helical crimped fibers) when submitted to similar process conditions. A broader range of mechanically crimped feed fibers can make satisfactory fiberballs when subjected to other fiberball making processes such as the one described in copending U.S. patent application Ser. No 07/840,285, filed Feb. 24, 1992 (DP-4690-A), by Snyder et al., the disclosure of which is incorporated herein by reference. In some cases, the structure of the fiberball is so similar to the one obtained from spiral crimped fibers that it is difficult to distinguish the two products, even in Scanning Electron Microscope (SEM) photographs of the fiberballs.

Producing fiberballs with a good structure from mechanically crimped fibers is of particular practical and commercial interest for fibers with special cross sections which are difficult to produce and/or crimp with the spiral crimp or bicomponent techniques, such as fibers having multiple channels and/or high void contents and high denier fibers. The technology disclosed makes it possible to produce fiberballs with a three dimensional structure, low cohesion, and good durability from practically any source of spun synthetic filaments, by modifying the crimping conditions and so producing a specific combination of primary and secondary crimp as disclosed. As will be recognized by those skilled in the art, any crimping operation must be to some extent empirical, as the expert will modify the crimping conditions according to the particular feed fiber, according to the type, dimensions and/or construction of crimper, and according to what is desired, experimenting until the results (in fiberballs, in the present instance) are satisfactory, but guidelines are given therein.

For filling purposes, fiberballs should preferably be round and have an average diameter of 2–20 mm, at least 50% by weight of the balls preferably having a cross section such that the maximum dimension is not more than twice the minimum dimension. The fiberballs are made up of randomly arranged, entangled, fibers that have been heat set to provide both a primary and a secondary crimp with specific frequency and amplitudes. A suitable primary crimp has an average frequency of about 14 to about 40 crimps per 10 cm, preferably about 18 to about 28 (or for some fibers to about 32) crimps/10 cm, with a suitable secondary crimp having an average frequency about 4 to about 16 per 10 cm and an average amplitude of the secondary crimp that is at least 4× the amplitude of the primary crimp. The crimped polyester fibers have a cut length of about 20 mm to about 100 mm and a linear density (for fiberfill purposes) of about 3 to about 30 dtex. Lower dtex levels will not generally provide good resilience or filling support. It will be understood that the ranges referred to herein are approximate, and that precise limits for any fiber will generally depend on various factors, such as desired end use, other fiber factors, such as denier and cross-sectional configuration, and the process conditions specifically selected for that particular fiber.

According to the present invention, as indicated, the fiberballs may contain a proportion, generally a minor amount up to 30% or more, although up to about 35%, or even 40%, by weight, or even up to half (about 50%) by weight of fibers of lower denier, i.e., lower than the fiberfill may be used to make the fiberballs. Such lower denier fibers are preferably what some refer to as subdenier fibers. As will be evident to those skilled in the art, now that it has been discovered how to make mechanically crimped fiber suitable for conversion into fiberballs, as well as converting spirally crimped fiber (as taught by Marcus), it is possible to make fiberballs from various blends of fibers, including blends of spirally crimped fibers and of mechanically-crimped fibers that are suitable for making fiberballs, with such lower denier fibers. Again, the precise proportions (and crimp configurations) of such fibers in such blends will depend on factors such as the technique to be used to make fiberballs, and the denier and cross-section of the fibers and, additionally for blends, the other constituents of the blend.

The fibers should be coated with a slickener such as a silicone slickener or a segmented copolymer consisting essentially of polyoxyalkylene and polyethylene terephthalate to reduce fiber/fiber friction. Besides the improved softness in the end-use product, the lubrication also plays an important role in the fiberball making process by helping the fibers to slide one on top of the other during the process, reducing the force required to roll them.

As indicated, Marcus U.S. Pat. Nos. 4,618,531 and 4,783,364 disclosed fiberballs produced from feed fibers having a spiral (or helical) crimp. Such fibers that have a helical crimp may be used instead of or in addition to the mechanically-crimped fibers as fiberfill to make fiberballs containing lower denier fibers, according to the present invention. Such fiberfill that has a helical crimp and methods of forming fiberballs therefrom is disclosed in the aforesaid Marcus patents, the disclosure of which is hereby incorporatd herein by reference. Such fiberballs have relatively few fibers sticking out of the fiberball and, as a result, a low cohesion between the fiberballs. The spiral crimp also provides optimal contribution of the fibers to the bulk, resilience and durability of the fiberfill, as well as the refluffability. The fiberball structure depends in great part on the spontaneous curling of the fibers due to the "memory" of the fibers, which results from their bicomponent structure or from spin stresses imparted during asymmetric quenching. The spontaneous curling potential allows fiberballs to be produced from the feed fibers under very mild conditions, applying very low forces to achieve a consolidated fiberball structure. The fiberballs have a resilient structure with excellent filling power and durability.

The main difference between such fiberballs and prior products referred to as "nubs", or similar commercial products, produced usually on cards, is that the "nubs" contain a very substantial amount of fibers that are present in a strongly entangled nucleus and do not contribute any resilience, but constitute simply a "dead weight". These nubs can be sufficiently strongly entangled so that they can resist a carding operation. Nubs are well adapted for incorporation into slub yarns (for example for berber carpets, tapestries and other textile uses requiring different visual and tactile aesthetics), but do not have the bulk, resilience and durability required for filling applications.

As indicated, Marcus produced his resilient fiberballs by using helically crimped fibers, and his air tumbling process fiber did not produce fiberballs from standard mechanically-crimped fibers. Helically crimped fibers remain a preferred feed for producing such products with the desired structure. The key to fiberball formation is believed to be in providing the feed fibers with a potential to spontaneously curl. Although this may not always be as strong as with bicomponent fibers, this potential to curl allows fiberballs to be produced under mild conditions, resulting in a similar structure. The crimp configuration of the fiber and the process conditions used to produce these fibers are important in regard to fiberball structure. Air tumbling conditions which did not produce any fiberballs with standard commercially available mechanically crimped fibers, may be used to produce a product with acceptable structure, filling power and durability from fibers with a modified mechanical crimp. The key parameter in the making of fiberballs with the optimal structure from these modified "mechanically crimped fibers" is the secondary crimp. It is the secondary crimp of these fibers which is believed to impart their potential to spontaneously curl, because it provides three-dimensional crimp configurations.

Feed fibers with a solid cross-section generally form fiberballs more easily than hollow fibers, particularly on the modified Lorch type equipment disclosed in U.S. Pat. Nos. 4,618,531, 4,783,364, and 4,794,038. On certain modified cards, differences due to the secondary crimp may be smaller, as regards an ability merely to make clusters. But the specific crimp remains important for the production of fiberballs with desirably good structure, durability, filling power (loft/bulk), and low cohesion. Although solid fibers and relatively low deniers are generally more easily rolled into fiberballs, fiberballs can be produced from fibers with a high bending modulus such as 13 dtex, 4-hole, 25% void fibers.

The polyester fibers used in the invention are desirably coated with a slickener. Any conventional slickening agent can be used for this purpose. Such materials are described in U.S. Pat. No. 4,794,038. Conventional slickeners are normally used at a level between 0.01 and about 1% Si on the weight of the fiber. Silicone polymers are used generally at concentrations in amounts (approximately) of 0.03% to 0.8%, preferably 0.15 to 0.3%, measured as % Si on the weight of the fiber. The slickener's role here is to reduce the cohesion between the filaments and allow the formation of a better structure during the fiberball making operation, to improve the slickness of the filling material, and to reduce the cohesion between the fiberballs (improving refluffability). As disclosed, however, the feed fibers can be coated with about 0.05% to about 1.2% by weight (of fiber) of a segmented co(polyalkylene oxide/polyethylene terephthalate), such as those disclosed in U.S. Pat. Nos. 3,416,952, 3,557,039, and 3,619,269 to McIntyre et al., and various other patent specifications disclosing like segmented copolymers containing polyethylene terephthalate segments and polyalkylene oxide segments. Other suitable materials containing grafted polyalkyleneoxide/polyethylene oxide can be used. The fiber/fiber friction achieved with these products is very similar to those achieved with silicones, but the fibers slickened with these materials do bond to commercial copolyester binder fibers and this is essential for the manufacturing of fiberballs for molding purposes, as disclosed in I. Marcus' copending U.S. application Ser. No. 07/549,847 (DP-4391) and in U.S. Pat. No. 4,940,502.

The invention is further described in the following Examples in which the fibers were all made from poly(ethylene terephthalate). All parts and percentages are by weight, and are OWF (based on the weight of the fibers), unless otherwise stated. The bulk measurements were made essentially as described by Marcus in U.S. Pat. No. 4,618,531.

EXAMPLE 1

Subdenier fibers (0.9 dpf) were cut to 1.25 inch lengths from a drawn tow of poly(ethylene terephthalate) filaments that had been mechanically-crimped and slickened with a polysiloxane slickener (about 0.3% Si OWF). Primary crimp frequency was measured in two ways as described herein; (CPI) measured 13 crimps/inch (about 5 crimps/cm), while chip (CHI) measured 17 crimps/inch (almost 11 crimps/cm). Secondary crimp (CHI) measured 1.4 crimps/inch (0.55 crimps/cm).

Higher denier fiberfill were also cut to 1.25 inch length from drawn tows of 4.5 dpf (A) for Ex 1A, and 6 dpf (B) for Ex 1B, both being mechanically-crimped poly(ethylene terephthalate), and slickened with a polysiloxane slickener to about 0.3% Si OWF. Primary crimp frequency (CPI) measured 6.1 crimps/inch for the 4.5 dpf and 4.7 crimps/inch for the 6 dpf. Primary crimp (CHI) values were 8.7 crimps/inch for the 4.5 dpf and 6.4 crimps/inch for the 6 dpf.

20% by weight of the subdenier fibers and 80% by weight of the higher denier fibers were blended on standard textile blending equipment. The resultant blend was opened on a Kirschner beater, and then air conveyed to feeding equipment that supplied a controlled amount of the blend to an apparatus as described by Snyder et al in U.S. patent application No. 07/840,285 for making fiberballs.

For comparison, fiberballs were also made similarly, but from 100% of the higher denier fiberfills, respectively, in comparison CA, using the 4.5 dpf fiberfill (A), in comparison CB, using the 6 dpf fiberfill (B), and in comparison CC, using a 4.25 dpf fiberfill having helical crimp (C), being the same as used in Example 1 of Snyder et al U.S. patent application Ser. No. 07/840,285, the disclosure of which is incorporated herein by reference.

The resulting fiberballs from Ex 1A and Ex 1B, and from Comparisons CA, CB and CC were collected and measured to compare their bulk, i.e., their heights (in cm) under the indicated loads (in Newtons), and their cohesion, both essentially, as described by Marcus in U.S. Pat. No. 4,618,531, IH being the "Initial Height" (in cm) under no imposed load, measured after the fiberball sample had undergone one precompression.

TABLE 1

| Item | Description | IH (cm) | Heights under Loads 5N (cm) | 88.5N (cm) | 121.5N (cm) | Cohesion (Newtons) |
|---|---|---|---|---|---|---|
| Ex 1A | 80/20 4.5/0.9 dpf | 28.6 | 25.7 | 8.0 | 6.0 | 5.3 |
| Ex 1B | 80/20 6/0.9 dpf | 28.6 | 25.2 | 8.2 | 6.2 | 5.5 |
| CC | 100% Helical 4.25 dpf | 28.5 | 23.8 | 6.5 | 4.7 | 4.8 |
| CA | 100% 4.5 dpf | 33.8 | 30.0 | 8,4 | 5.9 | 7.0 |
| CB | 100% 6 dpf | 32.6 | 28.7 | 8.5 | 6.1 | 7.9 |

Cohesion correlates quite well with refluffability, as discussed by Marcus in U.S. Pat. No. 4,618,531. As indicated in the aforesaid art, fibers having helical crimp have been optimum for making refluffable fiberballs, and this is indicated in Table 1, where the cohesion value for comparison CC (helical crimp fiberfill) is significantly better (lower) than for the mechanically-crimped fiber (Comparisons CA and CB). It is surprising that the refluffability (as indicated by a lower cohesion value) of mechanically-crimped fiberfill is improved by incorporation of 20% by weight of subdenier fibers, as indicated in Table 1 for items Ex 1A and Ex 1B. Also Ex 1A and Ex 1B have IH values comparable to that of Comparison CC (helical crimp fiberfill), indicating comparable initial loft or fill power, but are higher under applied loads, indicating that they are firmer.

EXAMPLE 2

Subdenier fibers (of both 0.9 dpf and 0.7 dpf) were prepared essentially similarly to those in Example 1.

The higher denier fiberfill was the 4.25 dpf fiberfill having helical crimp as for Comparison CC above (and as in Example 1 of application No. 07/840,525).

Various blends were prepared and formed into fiberballs similarly to the procedure described in Example 1 herein, and the measurement data are given in Table 2.

TABLE 2

| Item | Description | IH (cm) | Heights under Loads 5N (cm) | 88.5N (cm) | 121.5N (cm) | Cohesion (Newtons) |
|---|---|---|---|---|---|---|
| Ex 2A | 80/20 4.25/0.7 dpf | 28.2 | 24.3 | 5.5 | 3.5 | 5.8 |
| Ex 2B | 62/38 4.25/0.7 dpf | 28.0 | 23.6 | 5.1 | 3.2 | 7.0 |
| Ex 2C | 50/50 4.25/0.7 dpf | 25.0 | 21.5 | 5.3 | 3.6 | 6.8 |
| Ex 2D | 80/20 4.25/0.9 dpf | 29.5 | 24.2 | 5.2 | 3.5 | 5.3 |
| CC | 100% 4.25 dpf | 28.5 | 23.8 | 6.5 | 4.7 | 4.8 |

As can be seen from Table 2, at subdenier levels of 20% such fiberballs are comparable in loft or fill power with the 100% 4.25 dpf fiberfill, but much softer (less height) at high applied loads, and have cohesion values below 6, indicating acceptable refluffability, whereas the larger amounts of subdenier provide fiberballs with higher cohesion values.

TEST METHODS

Most of the measurements and test methods referred to herein are similar to those in the art referred to already, but the crimp measurements were made as follows.

Primary Crimp Measurement—(CPI)

A single fiber is positioned relaxed between both clamps of a device for measuring the length of a fiber. The clamps are first manually separated to extend the fiber to remove only any slack present without removing crimp. The total number of crimps, defined as peaks and valleys, is counted (using a magnifying glass). Then the fiber is further elongated until all crimp is just removed, and this uncrimped fiber length is measured.

$$\text{Crimps per Inch} = \frac{\text{Total number of crimps}}{\text{uncrimped fiber length (in inches)}}$$

This measurement is made on at least 10 filaments, using several feet of crimped tow, and selecting several representative sections, from which tufts are cut and then individual filaments are extracted, and the average is calculated and used as the "CPI".

Primary Crimp Measurement (CHI)

A specimen of staple or tow is placed on a flat surface under no tension. A template with two parallel lines 1 inch apart is placed over several sections of the specimen and the crimps (peaks only) per each 1 inch section are counted using a magnifying glass and extra illumination. This exercise is repeated at least 10 times, and CHI is the average of these 10 determinations.

Secondary crimp was measured herein by essentially the same method as for CHI, except that the entire tow band was examined.

Pillows, cushions and other filled articles may be prepared from the fiberballs by conventional methods, as described in the art, including art referred to hereinbefore, e.g., by blowing into a suitable fabric enclosure, referred to generally as ticking. Particularly good aesthetics have been obtained, according to the invention, using a woven filament yarn fabric incorporating subdenier filaments as the ticking. For instance, a sanded fabric comprising, by weight, 74% warp and 26% fill, weighing 3.5 oz./sq. yd, with the fabric being constructed from a warp that was 50 denier, 47 filament yarn of clear round poly(ethylene terephthalate) filaments, and from fill that was a 60 denier, 100 filaments, has given very good aesthetics for pillows. Thus, an important aspect, according to the invention is the continuation of a woven fabric comprising filament yarns as the ticking, with the filaments comprising 10 to 50% by weight of filaments of dpf less than about 1, especially with filaments of average dpf of less than 1.5 for the fabric as a whole. Use of low dpf filamentary yarn, especially of polyester filaments or other synthetic filaments is believed novel, as tickings, and especially in combination with pillows filled with fiberballs, or like support articles filled with fiberballs.

We claim:

1. Improved fiberballs having a random distribution and entanglement of individual fibers within each fiberball and of average diameter about 2 to 20 mm, comprising crimped fibers that are slickened and of length about 10 to about 100 mm, the improvement being characterized in that the fibers consist essentially of about 10 to about 50% by weight of lower denier fibers of lower denier about 0.2 to about 1.5, and complementally about 90 to about 50% of fiberfill of higher denier that is about 2 to about 20, and is at least about 3 times said lower denier, and said fiberfill being mechanically-crimped with significant secondary crimp, in addition to primary crimp, whereby such fibers are entangled in the form of fiberballs.

2. Improved fiberballs having a random distribution and entanglement of individual fibers within each fiberball and of average diameter about 2 to about 20 mm, comprising fibers that are slickened and of length about 10 to about 100 mm, the improvement being characterized in that the fibers consist essentially of about 10 to about 50% by weight of lower denier fibers of lower denier about 0.2 to about 1.5, and complementally about 90 to about 50% of fiberfill of higher denier that is about 2 to about 20, and is at least about 3 times said lower denier, and said fiberfill having a helical crimp whereby such fibers are entangled in the form of fiberballs.

3. Improved fiberballs having a random distribution and entanglement of individual fibers within each fiberball and of average diameter about 2 to 20 mm, comprising fibers that are slickened and of length about 10 to about 100 mm., the improvement being characterized in that the fibers consist essentially of about 10 to about 50% by weight of a lower denier fibers of lower denier about 0.2 to about 1.5, and complementally about 90 to about 50% of fiberfill of higher denier that is about 2 to about 20, and is at least about 3 times said lower denier, some of said fiberfill having a helical crimp, and some of said fiberfill being mechanically-crimped with significant secondary crimp, in addition to primary crimp, whereby such fibers are entangled in the form of fiberballs.

4. Fiberballs according to any one of claims 1, 2 or 3, that contain 10 to 30% by weight of said lower denier fibers and complementally 90 to 70% of said fiberfill of higher denier.

5. Fiberballs according to any one of claims 1, 2 or 3, wherein said lower denier is about 0.6 to about 1.

6. Fiberballs according to any one of claims 1, 2 or 3, wherein said higher denier is about 4 to about 10.

* * * * *